US009078476B2

(12) United States Patent
Haueter

(10) Patent No.: US 9,078,476 B2
(45) Date of Patent: Jul. 14, 2015

(54) GI WITH TANGLE-PROOF DRAWSTRING

(71) Applicant: Christopher Haueter, Redondo Beach, CA (US)

(72) Inventor: Christopher Haueter, Redondo Beach, CA (US)

( * ) Notice: Subject to any disclaimer, the term of this patent is extended or adjusted under 35 U.S.C. 154(b) by 0 days.

(21) Appl. No.: 13/623,050

(22) Filed: Sep. 19, 2012

(65) Prior Publication Data

US 2014/0075648 A1 Mar. 20, 2014

Related U.S. Application Data

(60) Provisional application No. 61/536,480, filed on Sep. 19, 2011.

(51) Int. Cl.

| | |
|---|---|
| ***A41D 1/06*** | (2006.01) |
| ***A41D 1/08*** | (2006.01) |
| ***A41F 9/00*** | (2006.01) |

(52) U.S. Cl.

CPC ... *A41D 1/08* (2013.01); *A41F 9/00* (2013.01); *A41D 1/06* (2013.01); *A41D 2300/33* (2013.01)

(58) Field of Classification Search

CPC ..... A41F 9/00; A41F 9/02; A41F 9/025; A41D 2300/33; A41B 2300/33

USPC ..... 2/79, 227, 219–221, 223, 235–237, 2/114, 69

See application file for complete search history.

(56) References Cited

U.S. PATENT DOCUMENTS

| | | | | | |
|---|---|---|---|---|---|
| 167,315 | A * | 8/1875 | Eager | 2/237 |
| 167,316 | A * | 8/1875 | Eager | 2/237 |
| 167,319 | A * | 8/1875 | Eager | 2/237 |
| 167,320 | A * | 8/1875 | Eager | 2/237 |
| 176,939 | A * | 5/1876 | Eager | 2/237 |
| 403,457 | A * | 5/1889 | Brown | 2/237 |
| 464,916 | A * | 12/1891 | Taylor | 450/95 |
| 598,604 | A * | 2/1898 | Marsden | 2/237 |
| 849,060 | A * | 4/1907 | Friedbaum | 2/236 |
| 898,511 | A * | 9/1908 | Schneider | 2/221 |
| 1,147,225 | A * | 7/1915 | Feldman | 2/237 |
| 1,208,132 | A * | 12/1916 | Gaines | 2/221 |
| 2,281,872 | A * | 5/1942 | Donnelly | 2/237 |
| 2,349,019 | A * | 5/1944 | Terrell | 2/221 |
| 2,541,713 | A * | 2/1951 | Neilson | 2/237 |
| 2,854,670 | A * | 10/1958 | Naccash | 2/237 |
| 3,007,175 | A * | 11/1961 | Robson | 2/221 |
| 3,161,890 | A * | 12/1964 | Betz | 2/237 |
| 5,881,392 | A * | 3/1999 | Koerner et al. | 2/227 |
| RE36,905 | E * | 10/2000 | Noble et al. | 2/400 |
| 6,327,714 | B1 * | 12/2001 | Koerner | 2/236 |
| 6,618,863 | B2 * | 9/2003 | Blechman | 2/311 |
| 2007/0136930 | A1 * | 6/2007 | Dipietro | 2/227 |

* cited by examiner

*Primary Examiner* — Khoa Huynh
*Assistant Examiner* — Brieanna Szafran
(74) *Attorney, Agent, or Firm* — Gary L. Eastman, Esq.

(57) ABSTRACT

A Gi with tangle-proof drawstring of the present invention provides improvement over previously available Gi pants through the separation of drawstring from itself as it passes through waistband hem. The Gi with tangle-proof drawstring of the present invention minimizes the tangling of the drawstring by having a circumferential drawstring passing through a waistband hem formed with a plurality of channel stitches that isolate the waistband passing through the hem and out through the waistband guides. As the drawstring passes through the waistband hem of the Gi pants, the upper portions of drawstring and the lower loop of drawstring are separated and pass through a channel stitch gap thus separating adjacent portions of the drawstring thereby eliminating the tangling which often occurs through use.

10 Claims, 3 Drawing Sheets

GI WITH TANGLE-PROOF DRAWSTRING

RELATED APPLICATION

This application claims the benefit of priority to U.S. Provisional Patent Application Ser. No. 61/536,480, entitled "GI with Tangle-Proof Drawstring" filed on Sep. 19, 2011.

FIELD OF THE INVENTION

The present invention relates generally to athletic clothing. The present invention is more particularly, though not exclusively, directed to a martial arts Gi having a unique drawstring configuration that reduces tangling and binding during use.

BACKGROUND OF THE INVENTION

Clothing worn during sporting activities is often equipped with elastic waistbands to maintain the clothing in the proper position around the waist of the athlete. Drawstrings can often be provided alone, or in addition to an elastic waistband to provide additional tightness about the waist.

Martial arts practitioners use a highly specialized uniform which is commonly referred to as a "Gi" that includes a typically cotton fabric pants and shirt to create a free-flowing garment that allows a martial arts practitioner to move aggressively without physical limitations from the clothing.

Currently available Gis include a shirt that is wrapped partially around the torso of the practitioner, and tied using integral ties at the sides of the shirt. The pants include a drawstring that resides in a hem formed on the top of the pants, and wraps around the practitioner to be tied in front of the practitioner. A belt, often color-coded to indicate the skill level of the practitioner, is wrapped around the waist and tied.

A significant problem with existing Gis is that the drawstring that is incorporated into the Gi pants often becomes twisted during use or when laundering. Indeed, despite the most diligent care in untangling the drawstring before, during and after periods of use, the drawstring ultimately becomes twisted within the hem. A twisted drawstring quickly becomes uncomfortable and makes it very difficult to cinch the drawstring tightly about the waist, or release the drawstring following use.

In light of the above, it would be advantageous to provide a Gi pant that minimizes the tangling of the drawstring. It would be further advantageous to provide a Gi pant that is relatively easy to manufacture and relatively cost effective.

SUMMARY OF THE INVENTION

The present invention proposes a new Gi pant that minimizes the tangling of the drawstring. The Gi with tangle-proof drawstring of the present invention provides the pants having a circumferential drawstring passing through a waistband hem formed with a plurality of channel stitches that isolate the waistband passing through the hem and out through the waistband guides. As the drawstring passes through the waistband hem of the Gi pants, the upper portions of drawstring and the lower loop of drawstring are separated to define a channel stitch gap created between adjacent portions of the drawstring. Therefore, the Gi with tangle-proof drawstring of the present invention provides improvement over previously available Gi pants through the separation of the drawstring from itself as it passes through waistband hem. The present invention further provides a Gi pant that is relatively easy to manufacture and relatively cost effective.

BRIEF DESCRIPTION OF THE DRAWINGS

The nature, objects, and advantages of the present invention will become more apparent to those skilled in the art after considering the following detailed description in connection with the accompanying drawings, in which like reference numerals designate like parts throughout, and wherein.

DETAILED DESCRIPTION OF THE INVENTION

Figure 1:
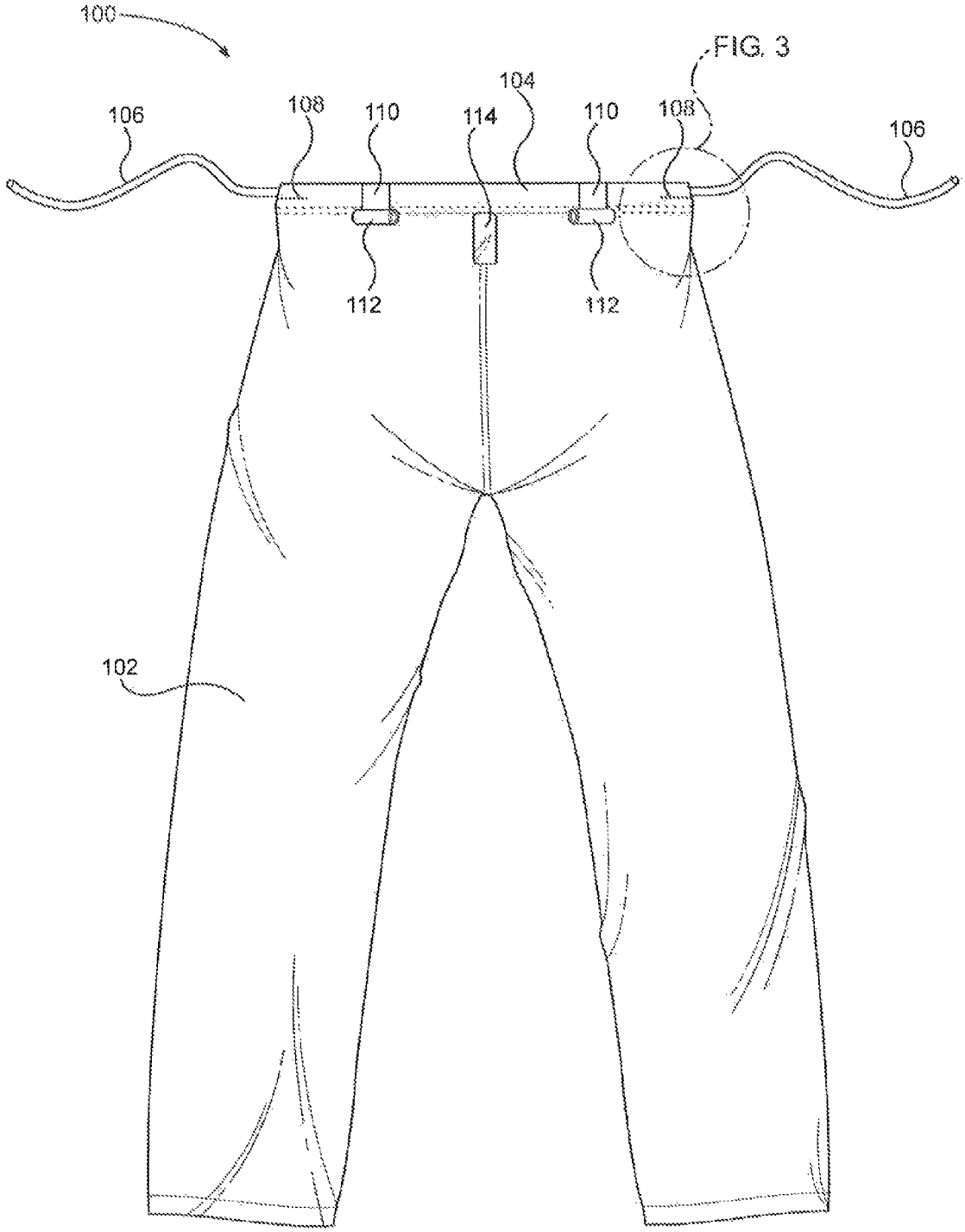
FIG. 1 is a diagrammatic representation of the Gi with tangle-proof drawstring of the present invention showing the pants having a circumferential drawstring passing through a waistband hem formed with a plurality of channel stitches that isolate the waistband passing through the hem and out through the waistband guides.

Referring now to FIG. 1, a diagrammatic representation of the Gi with tangle-proof drawstring of the present invention is shown and generally designated 100. Gi 100 includes pants 102 formed with a waistband hem 104. A circumferential drawstring 106 passes through the waistband hem 104 formed with a plurality of channel stitches 108 that isolate the waistband as it passes through the waistband hem 104. The drawstring 106 then exits the waistband hem 104 on the sides of the pant 102.

Once drawstring 106 exits the waistband 104, the ends of the drawstring 106 pass through waistband guides 112 attached to pant 102 with guide supports 110. The ends of the drawstring 106 then pass through center loop 114 and tied snugly about the practitioner.

Figure 2:
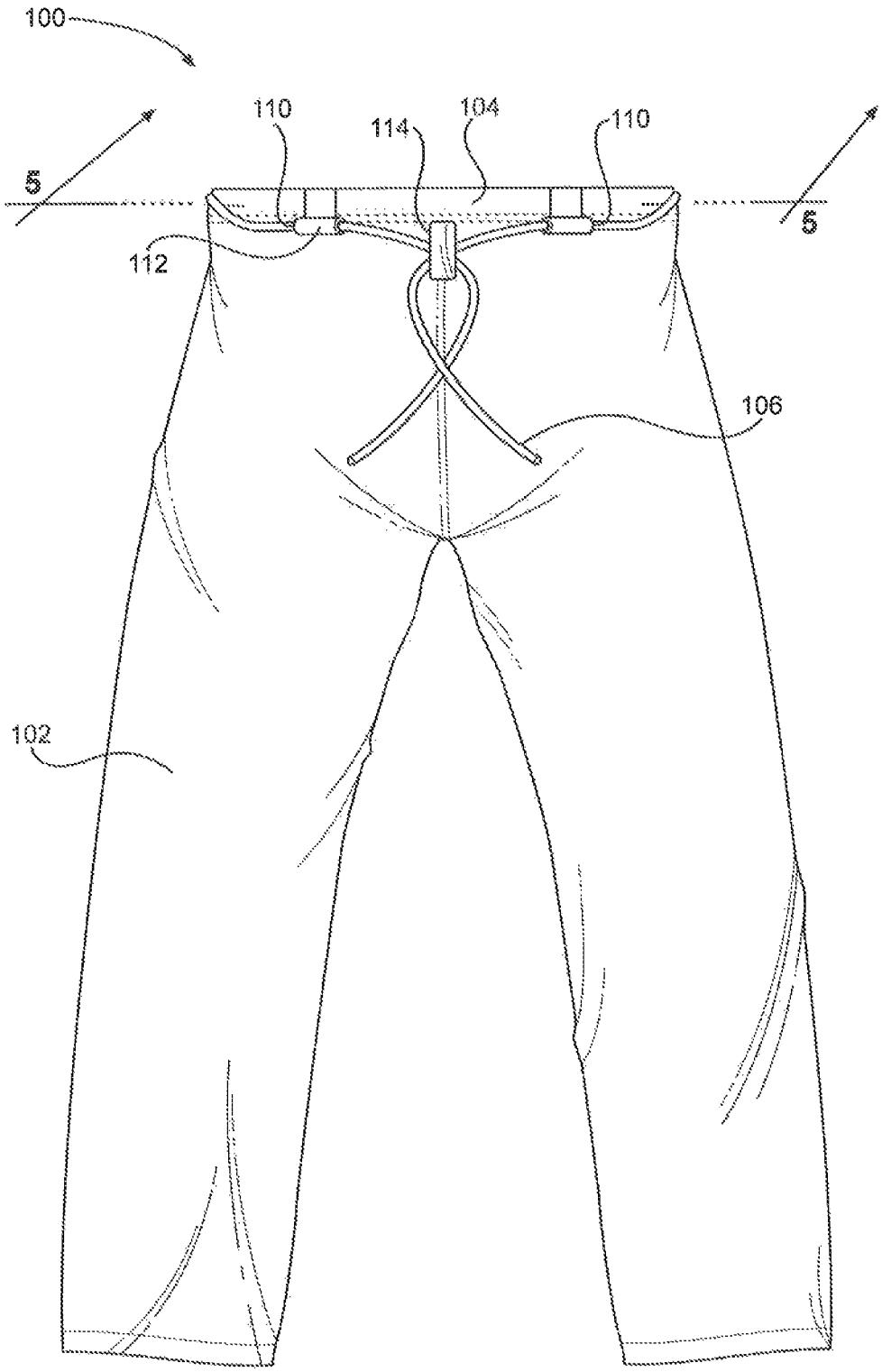
FIG. 2 is a diagrammatic representation of the Gi with tangle-proof drawstring of the present invention showing the drawstring passing from the waistband hem, through the waistband guides, and passing through a center loop for tying.

As shown in FIG. 2, drawstring 106 exits the waistband 104, and the ends of the drawstring 106 pass through waistband guides 112 attached to pant 102 with guide supports 110. The ends of the drawstring 106 then pass through center loop 114 and tied.

It is to be appreciated that the Gi with tangle-proof drawstring 100 of the present invention may not necessarily include the drawstring guide 112 and support 110. Rather, the present invention is capable of being realized with the inclusion of the channel stitches 108.

Figure 3:
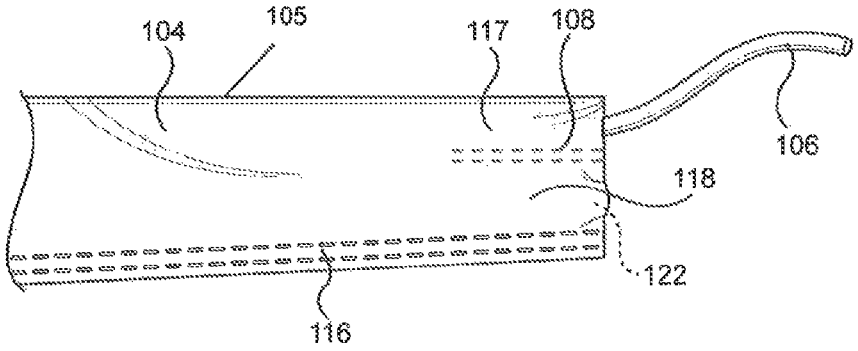
FIG. 3 is a detail view of the Gi with tangle-proof drawstring of the present invention as depicted in FIG. 1, showing the placement of the channel stitch in the waistband hem that defines an upper drawstring channel and a lower drawstring channel to maintain physical separateness between the portions of the drawstring as it passes through the waistband hem.

FIG. 3 is a detailed view of the Gi with tangle-proof drawstring 100 of the present invention as depicted in FIG. 1. This figure details the placement of hem stitching 116 and the channel stitches 108 in the waistband hem 104. These stitches cooperate to define an upper drawstring channel 117 between the channel stitches 108 and an upper fold 105 of the hem 104, and a lower drawstring channel 118 between the channel stitches 108 and the hem stitching 116, to maintain physical separateness between the portions of the drawstring 106 (not shown this Figure) as it passes through the waistband hem 104.

Figure 4:
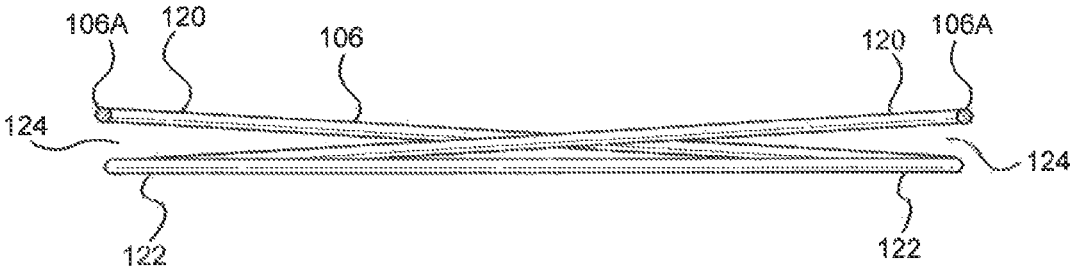
FIG. 4 is a representative drawing of the Gi with tangle-proof drawstring of the present invention showing the circumferential path of the drawstring as it passes through the waistband hem of the Gi pants and showing the channel stitch gaps created between adjacent portions of the drawstring.

Referring to FIG. 4, a representative drawing of the Gi with tangle-proof drawstring 100 of the present invention shows the circumferential path of the drawstring 106. Specifically, the drawstring 106 is shown separate from the hem 104 for illustration purposes only. It is to be appreciated that drawstring 106 loops around the entire hem of pants 102 and is contained within hem 104 except for the portions passing outside the hem for tying purposes. The drawstring enters hem 104 on one side of the pant 102, passes around the entire hem 104 and exits hem 104 on the opposite side of the pant 102, effectively passing through a 540 degree circumferential path within hem 104. As drawstring 106 passes through the waistband hem 104 of the Gi pants 102, the upper portions 120 of drawstring 106 and the lower loop 122 of drawstring 106 are separated to define a channel stitch gap 124 created between adjacent portions of the drawstring. Ends 106A are shown in cross-section as they leave hem 104 (not shown in this Figure).

It is also to be appreciated that while drawstring 106 exits the sides of hem 104 of pants 102 in the present embodiment, drawstring 106 may in an alternative embodiment exit the hem 104 closer to the front of the pant 102, such as adjacent the center loop 114. In such a configuration, the ends 106A of drawstring 106 would be cinched and tied in order to secure the pants 102 on the practitioner, In this embodiment, additional channel stitches 108 may be placed in hem 104 to maintain separateness of drawstring 106 within hem 104.

Figure 5:
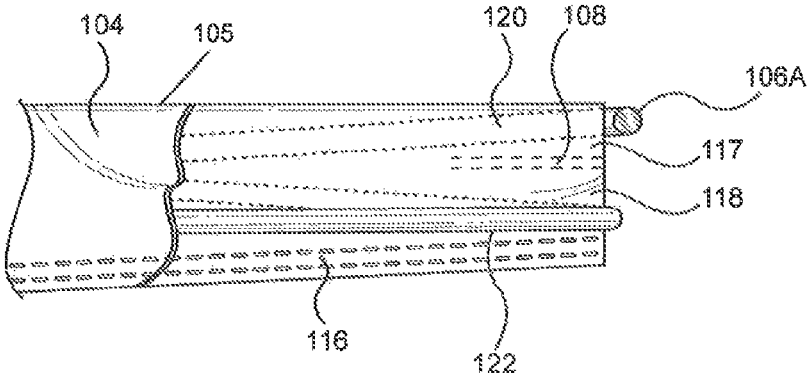
FIG. 5 is a representative drawing of the Gi with tangle-proof drawstring of the present invention showing the combination of FIGS. 3 and 4, as taken along line 5-5 of FIG. 2, with portions of the waistband hem cut away showing the passage of the drawstring through the waistband hem and passing through the upper channel and lower channel as separated by the channel stitching, and out through the side of the drawstring hem of the pants.

FIG. 5 is a representative drawing of the Gi with tangle-proof drawstring 100 of the present invention as taken along line 5-5 of FIG. 2 as viewed from the front of the pant 102 and showing the combination of FIGS. 3 and 4. From this view with portions of the waistband hem 104 cut away for clarity, the path of the drawstring 106 is clear as it passes through the waistband hem 104, the upper channel 117 and lower channel 118 as separated by the channel stitches 108, and out through the side of the waistband hem 104 of the pants 102.

It is to be appreciated that the Gi with tangle-proof drawstring 100 of the present invention provides improvement over previously available Gi pants through the separation of drawstring 106 from itself as it passes through waistband hem 104, Waistband hem 104 may be equipped with a channel stitch 108 on each right and left side of the waistband hem 104. Additional channel stitches 108 may be incorporated into other portions of the hem 104 and are fully contemplated herein and considered within the scope of the present invention.

What is claimed is:

1. A martial art apparel to be worn on the lower body of the wearer comprising:

a pants having an upper fold with a hem stitching defining a single, continuous waistband hem;

a circumferential drawstring having a first end and a second end, said circumferential drawstring forms a complete lower loop as said circumferential drawstring circumscribes the waist of the wearer, wherein said lower loop is contained entirely within said waistband hem, a first end upper portion adjacent said first end and a second end upper portion adjacent said second end between said first end and said second end of said circumferential drawstring;

a pair of channel stitches in said waistband hem to form an upper channel between said upper fold and said pair of channel stitches and a lower channel between said hem stitching and said pair of channel stitches, wherein a substantial portion of said circumferential drawstring is received within said upper and lower channels, said upper channel and said lower channel are interconnected by said waistband hem to allow said circumferential drawstring to pass between said upper channel and said lower channel; and wherein said circumferential drawstring passes through said waistband hem and wherein said circumferential drawstring passes between said upper channel and said lower channel while contained within said waistband hem, said lower loop of said circumferential drawstring passing through said entire lower channel and said first end upper portion and said second upper portion passes through said upper channel so that said first end and said second end exit out of said upper channel to be tied together.

2. The martial art apparel of claim 1 further comprising: a pair of waistband guides sized for said drawstring to pass therethrough, on said pant and positioned to facilitate tying said drawstring.

3. The martial art apparel of claim 1 further comprising a center loop sized for said drawstring to pass therethrough, and positioned to facilitate tying said drawstring.

4. The martial art apparel of claim 3, further comprising at least one guide support and at least one waistband guide, wherein said first end and said second end of said drawstring passed through said waistband hem may pass through said at least one waistband guide attached to said at least one guide support and said pant, and then pass through said center loop to be tied snugly about the wearer.

5. The martial art apparel of claim 2, wherein said pair of waistband guides connect to a pair of guide supports, attaching said pair of waistband guides to said pants.

6. The martial art apparel of claim 1, wherein said pair of channel stitches are positioned on each right and left side of said hem.

7. The martial art apparel of claim 1, wherein said drawstring exits said waistband hem closer to a front portion of said pants.

8. The martial art apparel of claim 7, further comprising one or more additional channel stitches in said waistband hem, and positioned to maintain separateness of said drawstring within said waistband hem.

9. The martial art apparel of claim 1, further comprising one or more additional channel stitches in said waistband hem.

10. A martial art apparel to be worn on the lower body of the wearer comprising:

a pants having an upper fold with a hem stitching defining a single, continuous waistband hem;

a circumferential drawstring having a first end and a second end, said circumferential drawstring forms a complete lower loop as said circumferential drawstring circumscribes the waist of the wearer, wherein said lower loop is contained entirely within said waistband hem, a first end upper portion adjacent said first end and a second end upper portion adjacent said second end between said first end and said second end of said circumferential drawstring;

a pair of channel stitches in said waistband hem to form an upper channel between said upper fold and said pair of channel stitches and a lower channel between said hem stitching and said pair of channel stitches, wherein a substantial portion of said circumferential drawstring is received within said upper and lower channels, said upper channel and said lower channel are interconnected by said waistband hem to allow said circumferential drawstring to pass between said upper channel and said lower channel;

a pair of waistband guides, each of said waistband guides attached to a front portion of said pant with a guide support;

a center loop attached to a center of said front portion of said pant and wherein said center loop is located between said pair of waistband guides;

wherein said circumferential drawstring passes through said waistband hem and wherein said circumferential drawstring passes between said upper channel and said lower channel while contained within said waistband hem, said lower loop of said circumferential drawstring passing through said entire lower channel and said first end upper portion and said second end upper portion passes through said upper channel so that said first end and said second end exit out of said upper channel to be tied together; and wherein said first end and said second end of said circumferential drawstring passes through said pair of waistband guides and is tied to said center loop.

* * * * *